US006883292B1

(12) United States Patent
Chen

(10) Patent No.: US 6,883,292 B1
(45) Date of Patent: Apr. 26, 2005

(54) CARPET PROTECTIVE FILM PACKING DEVICE

(76) Inventor: Hsiu-Man Yu Chen, No. 27, Sec. 1, Ta Fu Road, Tan Tzu Hsiang, Taichung (TW), 427

( * ) Notice: Subject to any disclaimer, the term of this patent is extended or adjusted under 35 U.S.C. 154(b) by 0 days.

(21) Appl. No.: 10/805,348

(22) Filed: Mar. 22, 2004

(51) Int. Cl.[7] ..... B65B 41/16

(52) U.S. Cl. ..... 53/389.1; 53/389.2; 53/390; 53/556

(58) Field of Search ..... 53/389.1, 390, 53/389.2, 556, 389.4; 242/557, 919, 588.2, 578.2, 278, 596; 156/574, 577, 579, 523

(56) References Cited

U.S. PATENT DOCUMENTS 1,967,748 A * 7/1934 Ehle ..... 156/461
4,213,278 A * 7/1980 Oberer ..... 451/500
4,324,370 A * 4/1982 Guard et al. ..... 242/403
4,372,500 A * 2/1983 Saraisky ..... 242/613.5
4,394,887 A * 7/1983 Spinks ..... 182/214
4,406,730 A * 9/1983 Altmix ..... 156/574
4,460,433 A * 7/1984 Boyd ..... 156/574
4,522,348 A * 6/1985 Strout et al. ..... 242/422.1
4,761,201 A * 8/1988 Nichols, Jr. ..... 156/497
5,042,221 A * 8/1991 Pacione ..... 52/749.1
5,243,865 A * 9/1993 Hsu et al. ..... 73/864.72
5,290,390 A * 3/1994 Roman et al. ..... 156/523
5,445,704 A * 8/1995 Dizon ..... 156/574
5,543,003 A * 8/1996 Regnier ..... 156/82
5,568,900 A * 10/1996 Conroy ..... 242/557
5,597,135 A * 1/1997 Vandersteene ..... 242/599.4
5,779,179 A * 7/1998 Zentmyer et al. ..... 242/423.2
5,846,175 A * 12/1998 Chen ..... 492/13
6,209,609 B1 * 4/2001 Edwards et al. ..... 156/577
6,284,076 B1 * 9/2001 Mattson ..... 156/71
6,296,033 B1 * 10/2001 Clements ..... 156/527
6,470,657 B1 * 10/2002 Huson et al. ..... 53/588
6,478,067 B1 * 11/2002 Huang ..... 156/511
6,547,054 B1 * 4/2003 Gamache ..... 193/37
6,561,453 B1 * 5/2003 Shinga ..... 242/595.1

* cited by examiner

*Primary Examiner*—Rinaldi I. Rada
*Assistant Examiner*—Hemant M. Desai
(74) *Attorney, Agent, or Firm*—Troxell Law Office, PLLC

(57) ABSTRACT

A carpet protective film packing device includes two side frames, two upper rotatable discs for supporting a film cylinder, an intermediate elongate rod, and a lower elongate roller. The intermediate rod is combined between the intermediate sections of the two side frames, adjustable in its length by an inner rod telescoping in an outer rod and fixed with a handle. The lower roller is pivotally connected between the lower ends of the two side frames for pressing and laying the protective film wound on the film cylinder supported by the two upper discs pivotally connected with the upper ends of the two side frames. Then the film cylinder and the lower roller is changeable to suit to the length of a carpet to be packed with a film, with the intermediate rod adjustable to suit with any length of the protective film to be used.

5 Claims, 9 Drawing Sheets

CARPET PROTECTIVE FILM PACKING DEVICE

BACKGROUND OF THE INVENTION

1. Field of the Invention

This invention relates to a carpet protective film packing device, particularly to one packing a protective film on the upper surface of a carpet to protect the carpet during transporting, storing and displaying before it is sold or used.

2. Description of the Prior Art

Medium-sized and large-sized carpets have to go through carrying, transportation, storing and displaying before they are sold to users, and it is important that they have to be protected clean until they are sold, by means of a film packed on their surface to keep dirt from soil them, and to be visible from outside of the film without need of stripping the film off the carpet. Thus, the protective film is very widely used for protecting medium-sized and large-sized carpets because of its convenience and tiny cost.

The packing of the protective film on a carpet is accomplished by manual work, with a carpet laid flat on the ground, and then a person bends the body and keels down to hold a film cylinder with one hand and to spread and lay a film on the upper surface of a carpet and then to roll the carpet with the film together into a roller, with two ends of the film stuck together of itself.

SUMMARY OF THE INVENTION

This invention has been devised to offer a carpet protective film packing device, which includes two symmetrical side frames, two upper rotatable discs, an intermediate elongate rod, and a lower elongate roller and a handle. The two upper rotatable discs are pivotally connected with the upper ends of the two side frames for supporting a film cylinder between them, and the intermediate elongate rod is fixed between the intermediate sections of the two side frames, consisting of an outer rod and an inner rod telescoping in the outer rod to let the whole length of the intermediate elongate rod adjustable to suit to the length of the film cylinder for a protective film to be wound thereon. The lower elongate roller is pivotally connected with the lower ends of the two side frames, also changeable to one of a proper length ti suit to the film cylinder. Then the lower end of the protective film is pulled to the lower elongate roller and pressed and laid by the lower elongate roller on the upper surface of a carpet placed flat on the ground by moving the handle of the carpet protective film packing device, which is also moved on the carpet. Therefore, the device can carry out packing the protective film on a carpet with comfortableness and quickness without bending and keeling required in the conventional manual way.

BRIEF DESCRIPTION OF DRAWINGS

This invention will be better understood by referring to the accompanying drawings, wherein.

DETAILED DESCRIPTION OF THE PREFERRED EMODIMENT

Figure 1:
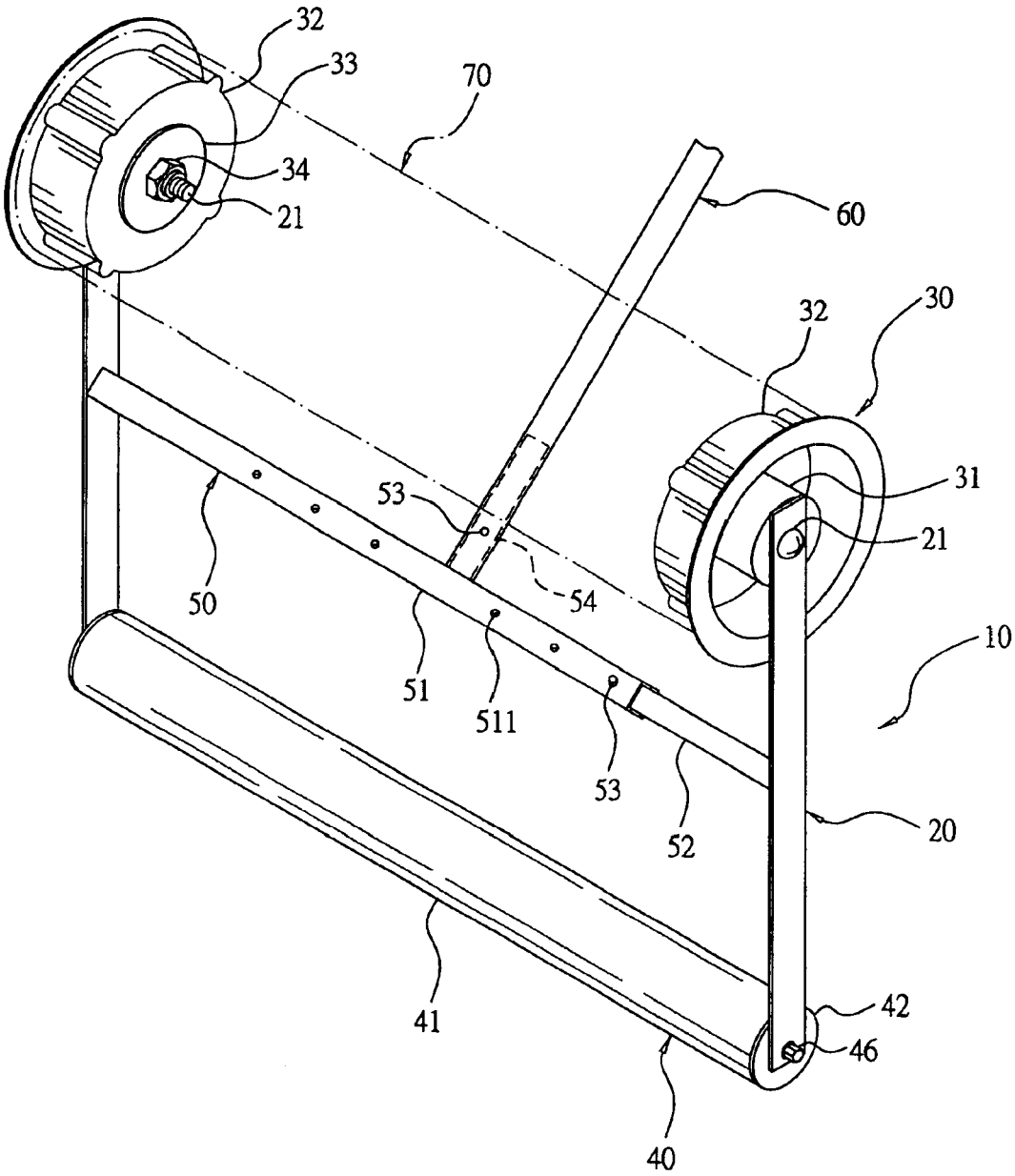
FIG. 1 is a perspective view of a carpet protective film packing device in the present invention.
Figure 2:
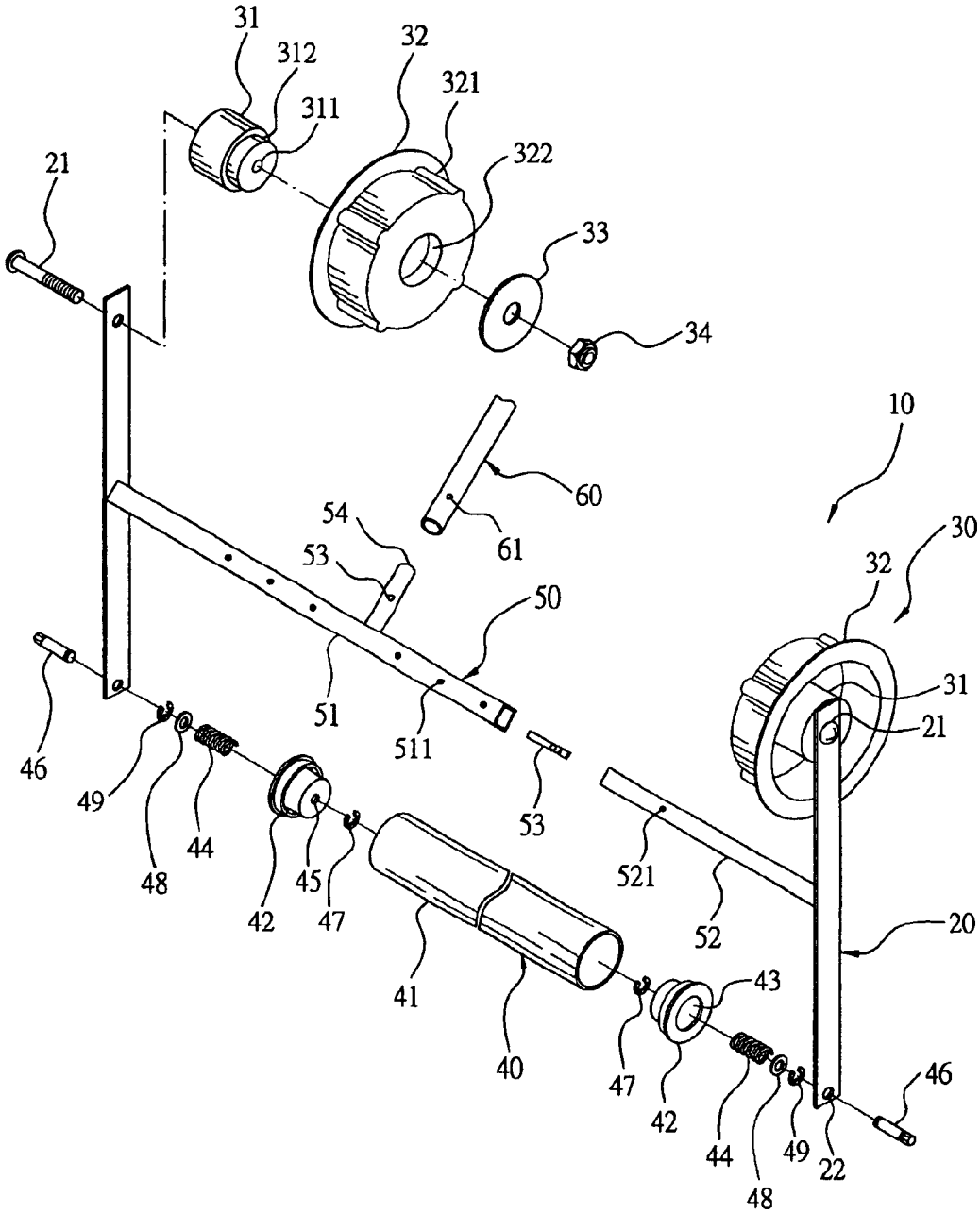
FIG. 2 an exploded perspective view of a carpet protective film packing device in the present invention.

A preferred embodiment of a carpet protective film packing device 10 in the present invention, as shown in FIGS. 1 and 2, includes two side frames 20, an two upper rotatable discs 30, a lower elongate roller 40, an intermediate elongate rod 50 and an elongate handle 60 as main components combined together.

The two side frames 20 are symmetrical to be placed at the left and the right side, respectively having a position bolt 21 formed integral at an upper end and a pinhole 22 in a lower end.

Figure 3:
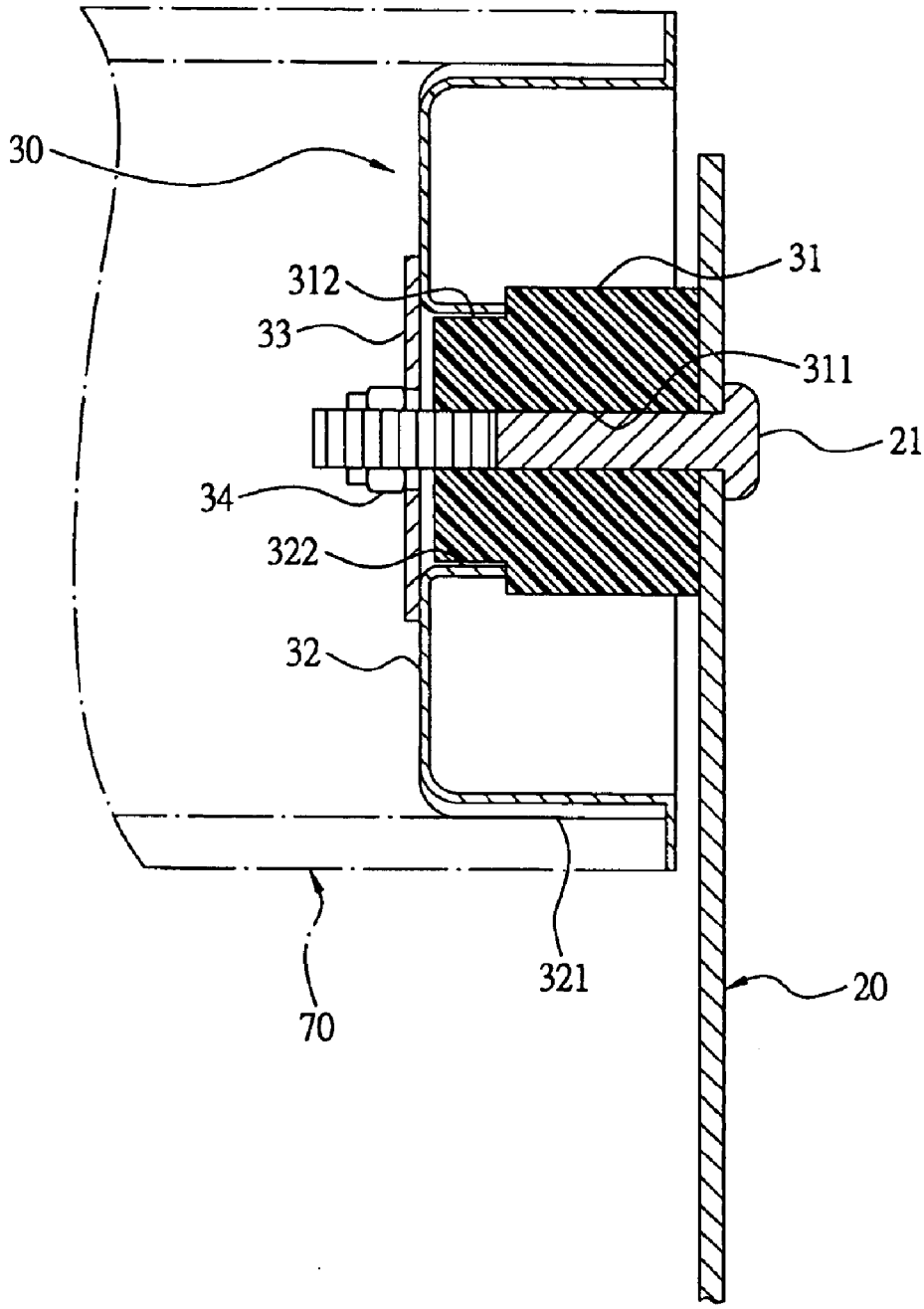
FIG. 3 is a cross-sectional view of a rotating member in the present invention.

The two upper rotatable disc, as shown in FIG. 3, respectively have a central circular member 31 and a rotatable member 32 positioned around the central circular member 31 at two ends. The central circular member 31 is shaped as a post and made of plastic, having a bolthole 311 in the center for the position bolt 21 of the side frames 20 to pass through, and an annular position edge 312 of a smaller diameter than the rest portion. The rotatable member 32 is shaped like a cap, having a plurality of rib-like ridges 321 spaced apart equidistantly around the outer surface, fitting tightly in the ends of the film cylinder 70, and a center hole 322 to fit with the annular position edge 312 of the central circular member 31, with the bolt 21 screwing with a nut 34 with a washer 33 placed therebetween, letting each of the rotatable members 32 rotate freely around the annular position edge 312 of the center circular member 31.

Figure 4:
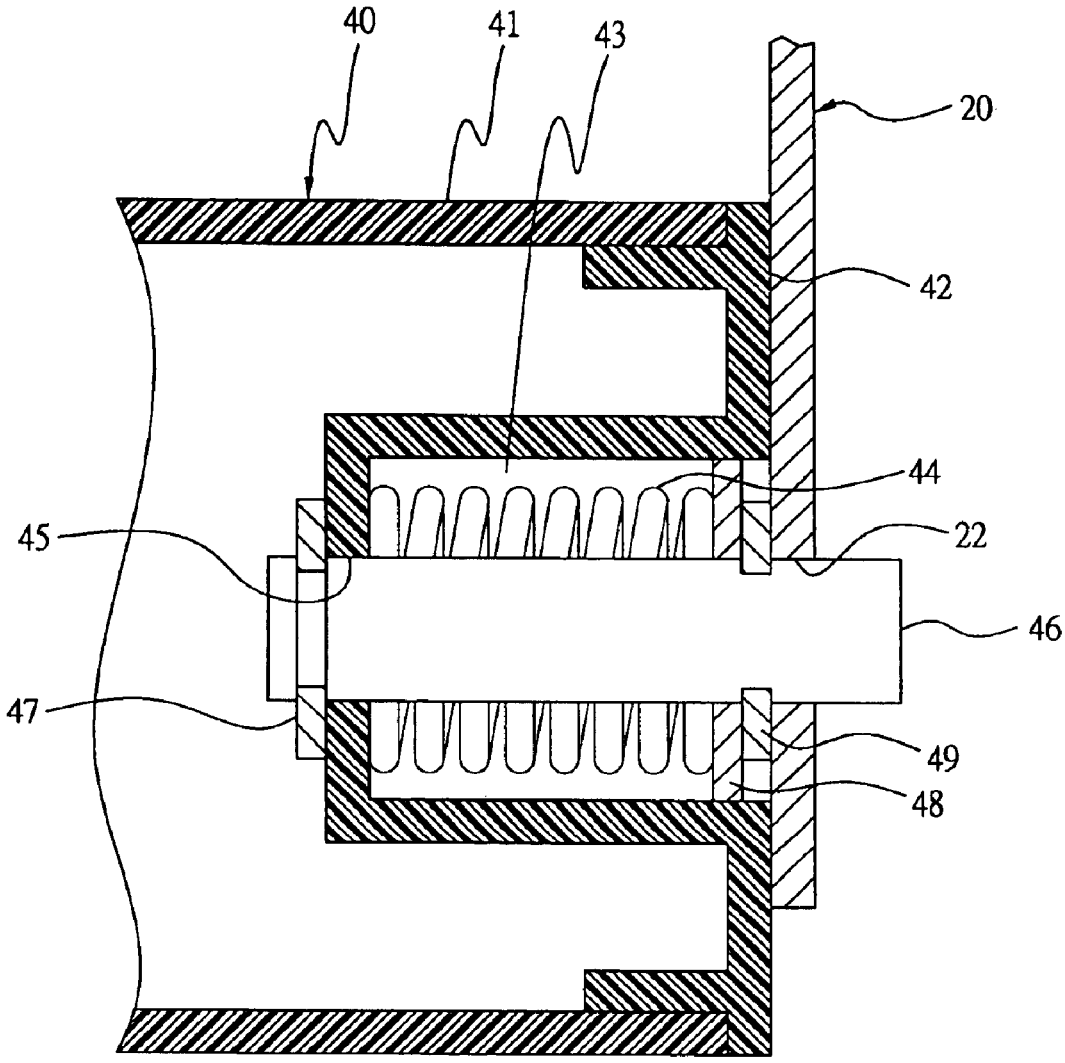
FIG. 4 is a cross-sectional view of the end of a lower roller in the present invention.
Figure 5:
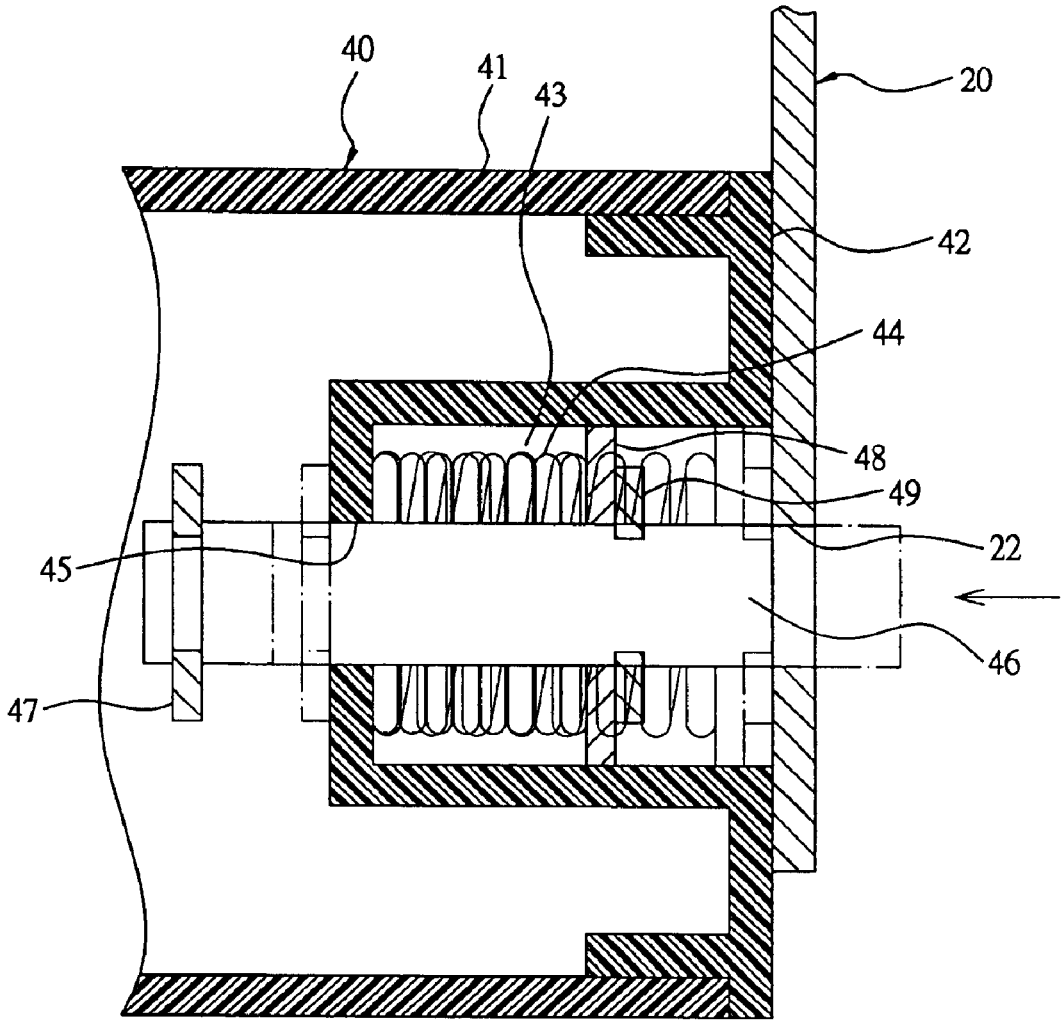
FIG. 5 is a cross-sectional view of the end of the lower roller in the present invention, showing a spring of a bolt pressed to shrink.

The lower elongate roller 40, as shown in FIGS. 4 and 5, having an elongate roller body 41 with a hollow interior and two end caps 42 closing respectively the two ends of the roller body 41 and provided with a hollow 43 with an outward opening for receiving a spring 44 therein and a hole 45 bored in the bottom defining the hollow 43. Then a pin 46 is deposited in the hollow 43 and passes through the spring 44, with its inner end retained by a helical spring lock washer 47 at the outer side of the hole 45 and its outer end kept to pass through pin hole 22 of the frame 20 with a washer 48 and a helical spring lock washer 49. Thus the two ends of the lower elongate roller 40 are pivotally connected between and with the lower ends of the two side frames 20. If the pin 46 of the lower roller 40 is pressed inward to compress the spring 44, the end of the lower roller 40 may be disassembled from the side frame 20.

Figure 6:
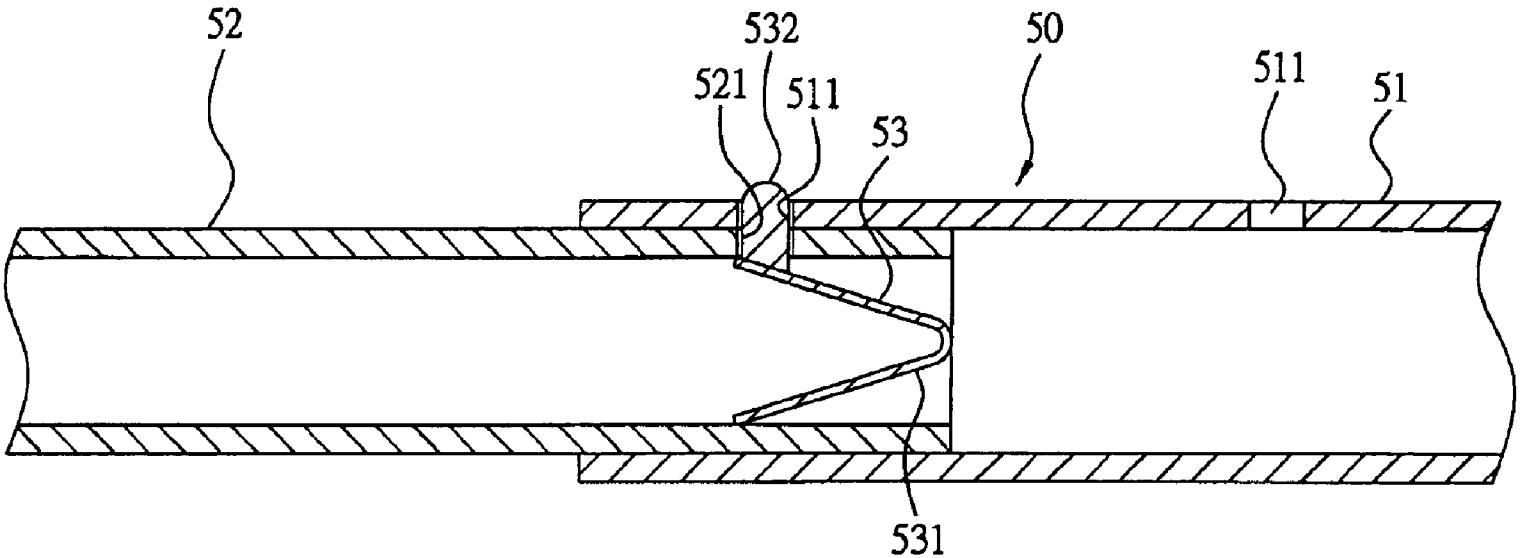
FIG. 6 is a cross-sectional view of an intermediate elongate rod with its length adjusted by a V-shaped spring in the present invention.

The intermediate elongate rod 50, as shown in FIG. 6, consists of an outer rod 51 and an inner rod 52 fitted and telescoping in the outer rod 51, and the outer ends of both the outer and the inner rod 51 and 52 are firmly welded with intermediate sections of the two side frames. A retainer 53 is provided at an inner end of the inner rod 52, having a V-shaped spring 531 and a post-like projection 532 fixed upright at an upper end. Further, the outer rod 51 has a plurality of position holes 611 spaced apart equidistantly near the inner end for the projection 532 elastically pushed up by the V-shaped spring to fit in one of the position holes 611 to keep the intermediate elongate rod 50 at the adjusted length by telescoping the inner rod 52 relative to the outer rod 51. In addition, the outer rod 51 has a handle combing foot 54 fixed firmly in sloping-up direction near the intermediate section, and the handle combining foot 54 has another retainer 53 of the same one 53 of the outer rod 51 for retaining the handle 60 so as to hold the handle 60 to use and move the carpet protecting film packing device 10.

The handle 60 is shaped as an elongate rod, having a position hole 61 near the lower end for the retainer 53 of the handle combing foot 54 to fit with to secure the handle with the foot 54.

Figure 7:
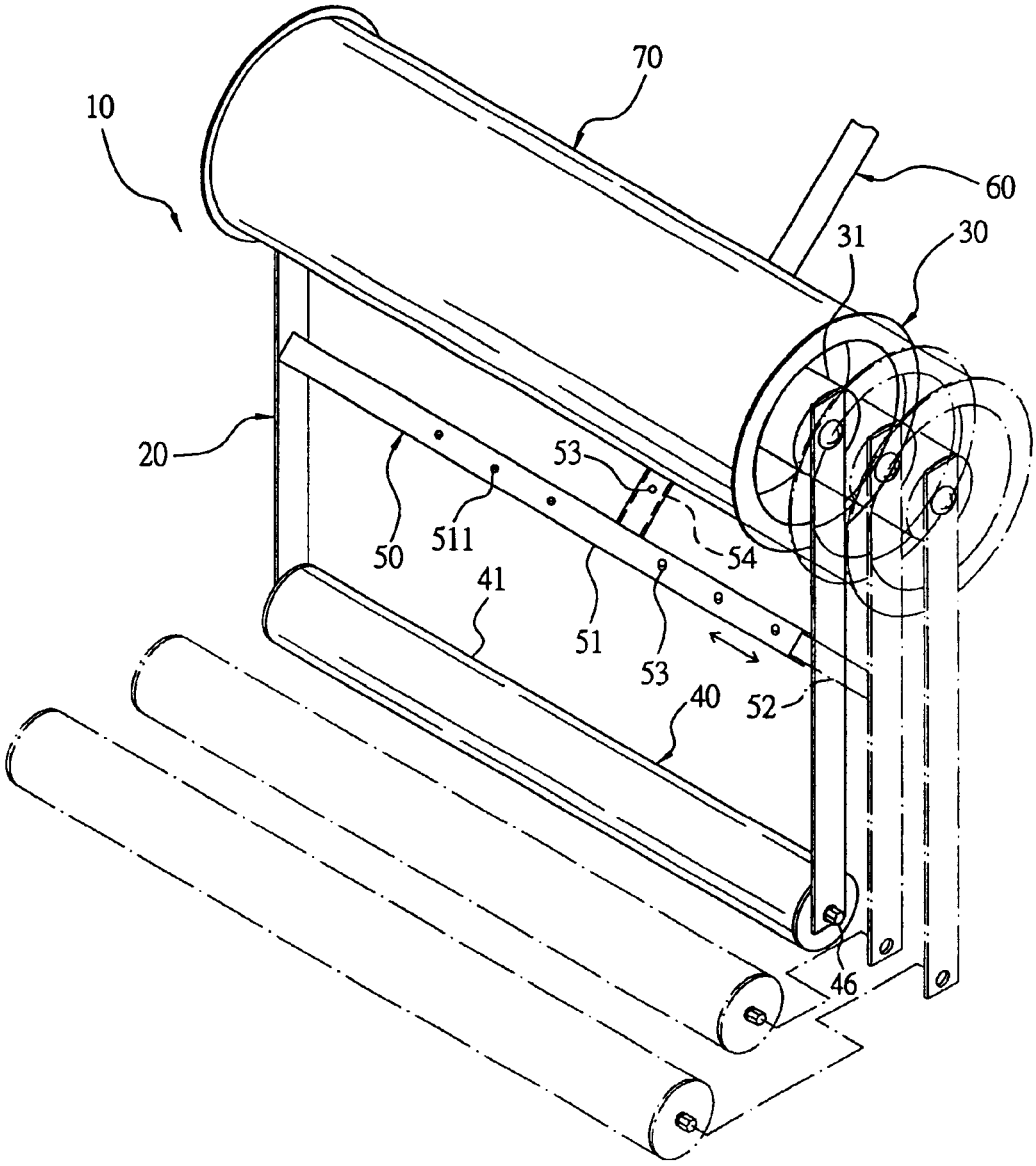
FIG. 7 is a perspective view of the intermediate elongate rod adjusted in its length in the present invention.
Figure 8:
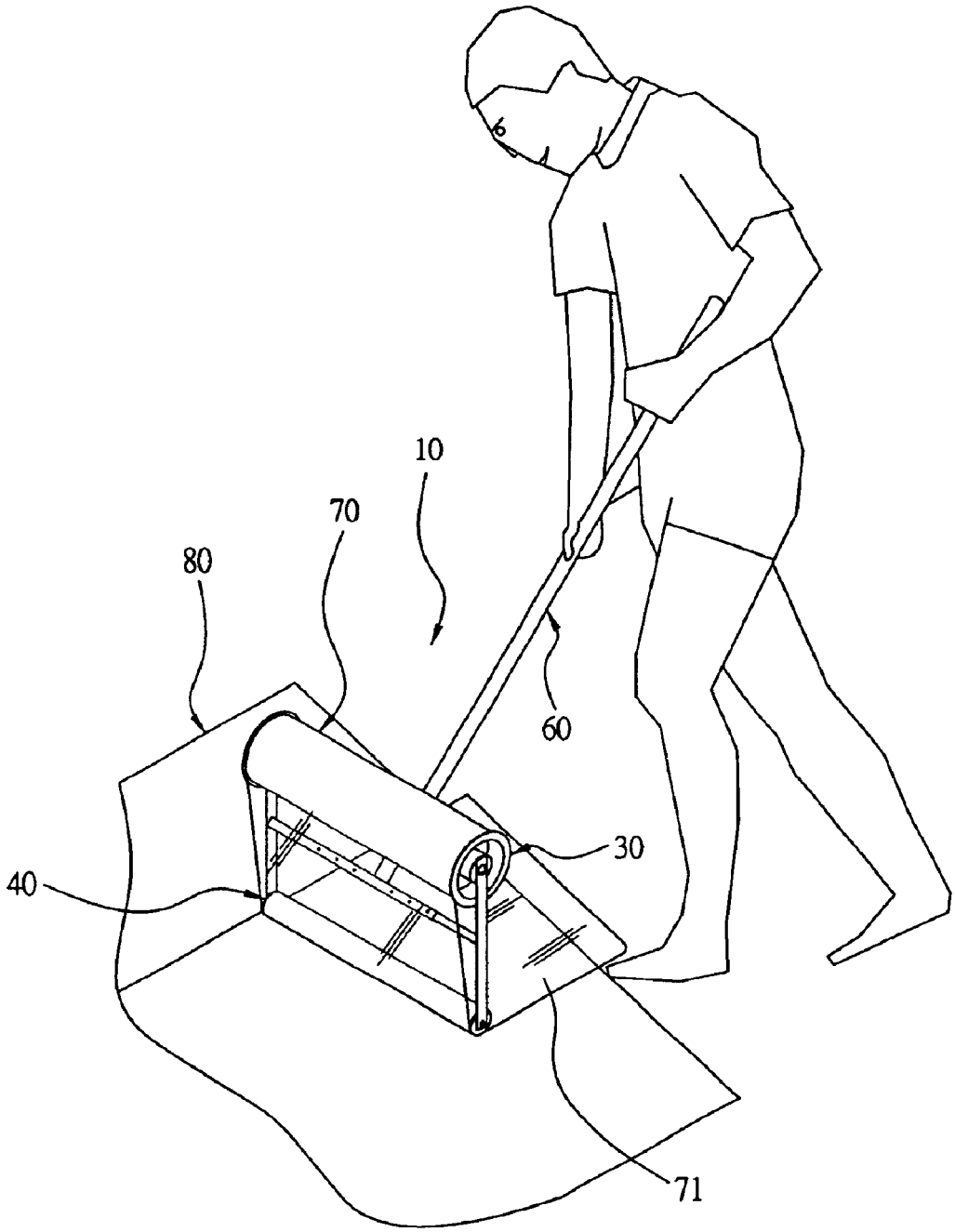
FIG. 8 is a perspective view of using the carpet protective film packing device, in the present invention; and, FIG. 9 is perspective view of an elongate roller of used instead of the two upper rotatable discs in the present invention.

Next, as shown in FIGS. 7 and 8, in using the packing device in the invention, at first the protective film is prepared and wound on the film cylinder 70 selected according to the width of a carpet 80 to be packed. Before fitting the film on the cylinder 70, the pin 46 of the lower roller 40 has to be pressed inward, shrinking inside the hollow 43 by compressing the spring 44 and separating from the pinhole 22 of the side frame 20. Then the lower elongate roller 40 is taken off the side frames 20. Next, the length of the intermediate elongate rod 50 is adjusted by pressing the projection 532 of the intermediate rod 50 to separate the inner rod 52 from the outer rod 51, an then the inner rod 52 is pulled outward to adjusted the whole length of the intermediate rod 50 by letting the projection 532 fit in the proper one of the position holes 511 to secure the inner rod 52 with the outer rod 51 at the adjusted length. Then the distance between the two side frames 20 are properly adjusted to suit to the intermediate rod 50, and the pins 40 of the lower roller 40 is made to fit in the pin holes 22 of the two side frames to change the lower roller 40 of a proper length. Here, it is essential to say that the film cylinder 70 of the proper length has to be combined with the two rotatable members 32 of the upper discs 30, before the intermediate rod 50 is combined with the two side frames 20. Then the carpet protective film packing device 10 is ready for packing the protective film 70 on a carpet 80.

Next, as shown in FIG. 8, the carpet 80 is spread out flat on the ground or the like, and the film 71 on the cylinder 70 is pulled down to the bottom of the lower roller 40, and the handle 60 is moved to make the lower roller 40 press the film 71 on the outer edge of the carpet 80. Then the handle 60 is controlled to roll on the upper surface of the carpet 80 with the film 71 gradually, pulled out of the cylinder 70 and laid on the carpet 80, which is easily covered with the film 71 for protection.

Figure 9:
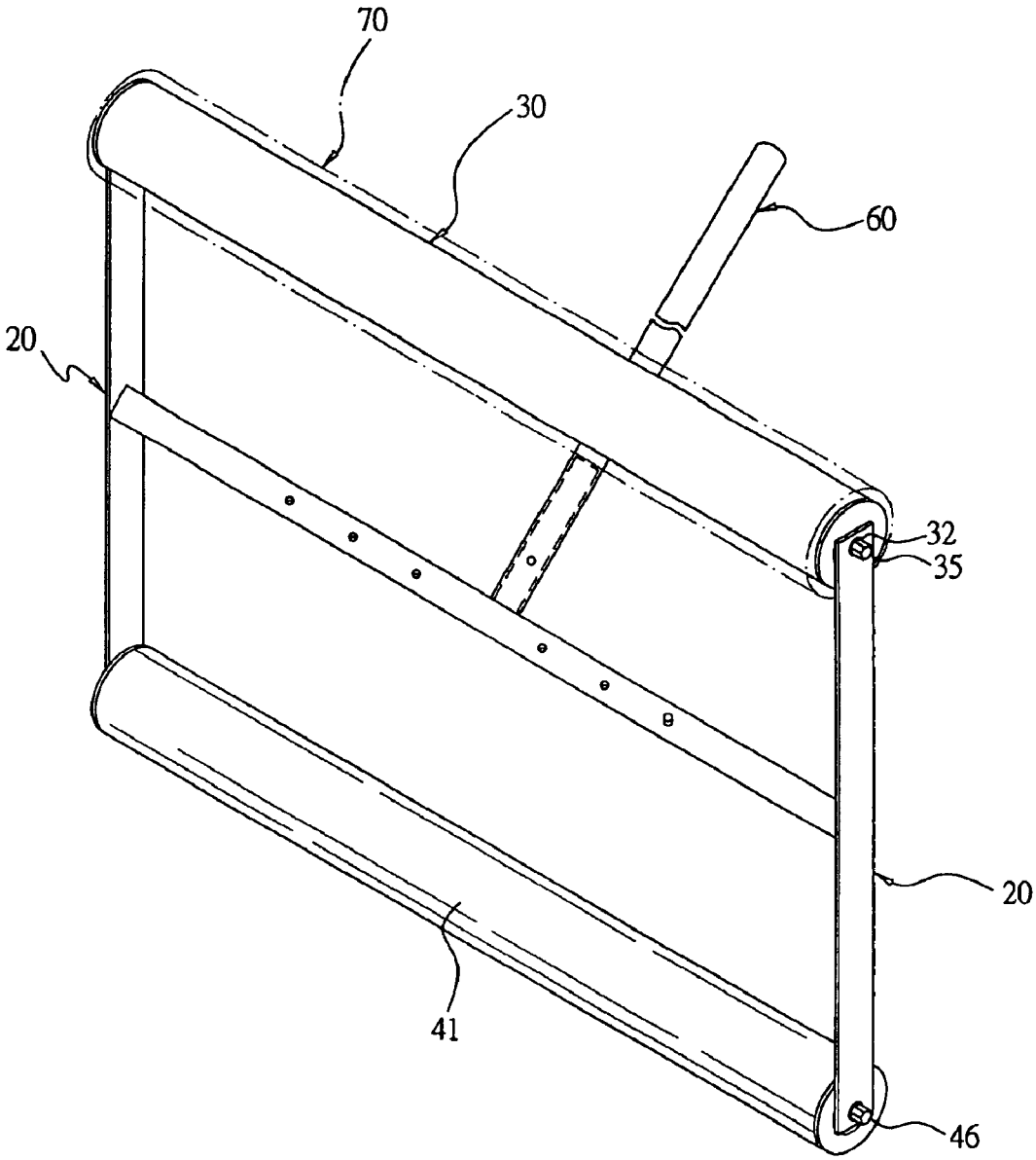

Furthermore, FIG. 9 shows an elongate roller 30 of the same shape of the lower roller 40 can be used instead of the two rotatable discs 30, and the roller 30 directly passes through the center of the film cylinder 70 lengthwise, and at least a pin 35 functioning as the pin 46 of the lower roller 40 is provided with one end of the elongate roller 30 to be pivotally connected in the pin hole 22 of the two side frames 20. Then the elongate roller 30 can support the film cylinder 70 for winding a film 71 thereon for operation.

Further, the handle 60 can be screwed tightly with the handle combing foot 54 of the intermediate rod 50 with a screw instead of the retainer 53.

In general, the carpet protective film packing device in the invention has the following advantages.

1. A user can hold the handle 60 by standing on the ground for performing packing a protective film 71 on a carpet 80 with comfortableness and quickness.
2. The film cylinder 70 can be changed to one with a proper length to suit to a carpet, by the intermediate elongate rod 50 adjustable in its length and lower elongate roller 40 is also alterable to one of a proper length to suit to the film cylinder 70, for packing the film 71 effectively.
3. The upper rotatable discs 30 can allow the film cylinder changed to a proper one with easiness and quickness.
4. The lower elongate roller 40 and the intermediate elongate rod 50 are both removable, convenient for manufacturing, assembling, storing and transporting.

While the preferred embodiment of the invention has been described above, it will be recognized and understood that various modifications may be made therein and the appended claims are intended to cover all such modifications that may fall within the spirit and scope of the invention.

What is claimed is:

1. A carpet protective film packing device comprising:

two side frames provided symmetrically:

Two upper discs respectively pivotally connected with upper ends of said two side frames for supporting and allowing a film cylinder wound with a protective film thereon to rotate for said film to be pulled out:

a lower elongate roller with a hollow interior, having two ends provided with a pin extending and pivotally connected with lower ends of said side frames so that said lower elongate roller rotate freely, said elongate roller thus to be assembled and disassembled for changing to one with a proper length suitable to said film cylinder, said elongate roller used to press and move the protective film pulled down from said film cylinder pivotally assembled with said two upper discs and to lay it on an upper surface of a carpet:

an intermediate elongate rod consisting of an outer rod and an inner rod fitted in said outer rod to telescope therein and secured at one of many positions to adjust a whole length of said intermediate rod, said outer rod and said inner rod having an outer end respectively firmly fixed with an intermediate section of each said side frame, said outer rod having a handle combining foot provided to extend sloping up outward for combining with a handle:

an elongate handle releasably connected with said handle combining foot of said intermediate elongate rod, a user holding said elongate handle for moving forwarded said carpet protective film packing device to force said lower elongate roller to roll and press said protective film to be laid closely on the carpet orderly for protecting the carpet.

2. The carpet protective film packing device as claimed in claim 1, wherein said two upper rotatable discs respectively consists of a center circular member and a rotatable member, said center circular member shaped like a post and made of plastic and having a center hole for a bolt fixed firmly on an inner upper wall of each said side frame to extend through inward, said center circular member further having an outer end provided with an annular position edge of a smaller diameter than the rest portion, said rotatable disc shaped as a cap and having a plurality of rib-like ridges spaced apart equidistantly on an outer annular surface, said outer surface with said ridges fitting tightly with each end of said film cylinder, said rotatable disc having a center hole to fit around said annular position edge of said center circular member, a bolt extending through the upper end of each said side frame and further through said center circular member and a washer and screwing with a nut tightly to let said rotatable member to rotate freely around said annular position edge of said center circular member.

3. The carpet protective film packing device as claimed in claim 1, wherein an elongate roller is used instead of said two upper rotatable discs, said elongate roller passing through lengthwise the center of said film cylinder and having two ends respectively provided with a pin extending in said bolt hole of said two side frames to allow said upper elongate roller rotate freely, at least one of said pin possible to be pressed to shrink inward to let said elongate roller assemble and disassemble and changed.

4. The carpet protective film packing device as claimed in claim 1, wherein said inner rod of said intermediate elongate rod has its inner end provided with a projection hole, and said outer rod has a plurality of position holes spaced apart equidistantly in a portion near the inner end, a retainer having a V-shaped spring to be positioned in said inner rod and a post-like projection extending up on an upper end, said post-like projection elastically pushed upward to fit in one of said holes of said outer rod to secure the inner rod with said outer rod at one of many adjusted position of said intermediate elongate rod by said retainer so that the whole length of the intermediate elongate rod is adjustable to suit to the length of said film cylinder.

5. The carpet protective film packing device as claimed in claim 1, wherein said handle combining foot of said intermediate elongate rod is a tubular tube welded with said outer rod, having a retainer with a V-shaped spring deposited in said handle combining foot and a post hole in its wall, said retainer having a post-like projection on an outer end, said post-like projection pushed elastically out by said V-shaped spring to extend through said post hole and then in a position hole of said handle to secure said handle with said intermediate elongate rod tightly.

* * * * *